US006130951A

United States Patent [19]

Nakamura et al.

[11] Patent Number: 6,130,951

[45] **Date of Patent: *Oct. 10, 2000**

[54] SPEAKER HAVING MULTIPLE SOUND BODIES AND MULTIPLE SOUND OPENINGS

[75] Inventors: Takeshi Nakamura, Uji; Yoshiaki Heinouchi, Jouyou, both of Japan

[73] Assignee: Murata Manfacturing Co., Ltd., Japan

[ * ] Notice: This patent is subject to a terminal disclaimer.

[21] Appl. No.: 09/054,043

[22] Filed: Apr. 2, 1998

Related U.S. Application Data

[63] Continuation-in-part of application No. 08/867,288, Jun. 2, 1997.

[30] Foreign Application Priority Data

Apr. 28, 1997 [JP] Japan ..... 9-111058

[51] Int. Cl.[7] ..... H04R 25/00

[52] U.S. Cl. ..... 381/337; 381/345; 381/338; 381/351; 381/354

[58] Field of Search ..... 381/338, 337, 381/345, 347, 348, 349, 351, 353, 162, 163, 357, 354

[56] References Cited

U.S. PATENT DOCUMENTS

| | | | |
|---|---|---|---|
| 2,399,513 | 4/1946 | Shapiro | 381/173 |
| 2,773,942 | 12/1956 | Christensen | 381/190 |
| 4,413,198 | 11/1983 | Bost | 310/324 |
| 4,700,100 | 10/1987 | Congdon | 310/332 |
| 4,714,133 | 12/1987 | Scaggs | 181/160 |
| 5,318,837 | 6/1994 | Yoshinaka et al. | 428/328 |
| 5,386,479 | 1/1995 | Hersh | 381/190 |

*Primary Examiner*—Huyen Le
*Assistant Examiner*—Dionne N. Harvey
*Attorney, Agent, or Firm*—Keating & Bennett LLP

[57] ABSTRACT

A speaker has a substantially reduced overall size while producing a complete low frequency sound range at high output amplitude. The speaker includes a main body having open sections at both ends thereof. A sounding body pinched by ringed first dampers is secured to each of the open sections of the main body so that the inside of the main body is kept air-tight. A first opening is provided at the middle part of the side of the main body. Lid members are secured on the outside of the two sounding bodies via a ringed second damper so as to keep the inside of the lid member air-tight. A second opening is created around the middle of the bottom of each of the lid members. A disc-like membrane is secured to the second dampers such that the lid members cover the membranes and cover the open section of the main body to keep the inside of the lid members air-tight.

18 Claims, 2 Drawing Sheets

SPEAKER HAVING MULTIPLE SOUND BODIES AND MULTIPLE SOUND OPENINGS

This Application is a Continuation-In-Part of U.S. patent application Ser. No. 08/867,288, filed Jun. 2, 1997 currently pending.

BACKGROUND OF THE INVENTION

1. Field of the Invention

The present invention relates to a speaker and more particularly to a speaker in which a piezoelectric body made of ceramic is used and adapted for use as a center channel woofer in a three dimensional ("3D") sound system such as a stereo system.

2. Description of Related Art

A speaker having a sounding body in the form of a piezoelectric member made of ceramic causes an amplitude of sound waves generated thereby to be insufficiently small. Accordingly, a speaker having the piezoelectric sounding body has not been used as a woofer for generating low frequency sound.

The inventor of the present invention has invented a speaker for functioning as a woofer and which comprises a piezoelectric body for generating low frequency sounds. This speaker is the subject of Japanese Patent Application No. Hei. 8-163854 and U.S. patent application Ser. No. 08/867,288. The disclosure of U.S. patent application Ser. No. 08/867,288 is hereby incorporated by reference.

The speaker disclosed in Japanese Patent Application No. Hei. 8-163854 and U.S. patent application Ser. No. 08/867,288 will be explained with reference to FIG. 3 herein. The speaker 1 includes a main body 2 having open sections at both ends thereof. Ringed dampers 6 are provided, respectively, at the open sections at both ends of the main body 2 and sounding bodies 3 are attached to the dampers 6. The sounding bodies 3 are secured so that the inside of the main body 2 is kept air-tight. A first opening 2*a* is provided at substantially the middle part of the side of the main body 2.

Further, lid members 4 are provided on the outside of the two sounding bodies 3 so as to cover the open sections at the both ends of the main body 2 and are secured so that the inside of the lid member 4 is kept air-tight. A second opening 4*a* is provided around substantially the middle of the bottom of the lid members 4. Sound absorbers 5 for absorbing and damping components of sound waves in the high sound range are preferably provided within the main body 2 and within the lid members 4.

The sounding bodies 3 preferably comprise a disc-like vibrating plate 3*a* made of metal and disc-like piezoelectric elements 3*b* are secured as a vibration source at the center part of both main surfaces of the vibrating plate 3*a* on a concentric circle of the vibrating plate 3*a* so as to have a bimorph structure. Although not shown specifically, the piezoelectric element 3*b* is constructed preferably by forming electrode films on both main surfaces of the disc-like piezoelectric body.

Both of the first opening 2*a* and the second opening 4*a* are smaller than an area of the vibrating plate 3*a* of the sounding body 3.

A first one of the two sounding bodies 3 is connected to a first input terminal (not shown) provided on the outside of the main body 2 preferably via a lead wire (not shown) end a second one of the two sounding bodies 3 is connected to a second input terminal (not shown) provided on the outside of the main body 2 preferably via another lead wire (not shown).

When an electrical signal is input from an amplifier (not shown) to the first input terminal, a corresponding one of the two sounding bodies 3 vibrates and when an electrical signal from the amplifier (not shown) is input to the second input terminal, the other of the two sounding bodies 3 vibrates.

The sounding bodies 3 are driven so that pressure within the main body 2 is increased/decreased at the same time by the two sounding bodies 3. That is, when one channel signal, e.g. a right channel signal, of a stereo signal is input to one input terminal, the other channel signal, i.e. a left channel signal, of the stereo signal is input to the other input terminal.

By inputting signals as described above, sound waves are generated within the main body 2 from the two sounding bodies 3 and are emitted from the first opening 2*a* of the main body 2. Sound waves are generated also within enclosed spaces located between the main body and each of the lid members 4 from the two sounding bodies 3 and are emitted from the second opening 4*a* of the lid member 4.

Because the area of the first opening 2*a* of the main body 2 is smaller than the area of the vibrating plate 3*a* of the sounding body 3 and the amplitude of the sound waves emitted from the first opening 2*a* of the main body 2 is larger than amplitude of the sound waves generated within the main body 2 from the two sounding bodies 3, the low frequency sound output therefrom is significantly increased. Further, because the sound waves in the middle/high frequency sound range generated from the two sounding bodies 3 have phases which are opposite from each other and are canceled within the main body 2, only the low frequency sound range is maximized and output from the first opening 2*a*.

Consequently, the speaker 1 generates a full low frequency sound range by using the piezoelectric body and without using a large vibrating plate, a large case or a large baffle plate.

Furthermore, because the sound absorbers 5 absorb and damp the high frequency sound range component of the sound waves generated within the main body 2 and within the sealed inner portions between the lid member 4 and the main body from the two sounding bodies 3, the low frequency sound range of the output sound waves is maximized as a result.

However, because each of the sounding bodies is comprised of the plate-like piezoelectric body, a vibration area of each sounding body is divided into a piston vibration area and a split vibration area depending on a frequency of signal input to the sounding body. That is, the speaker functions in the piston vibration area when the driving frequency is equal to a frequency of a standing wave and the speaker functions in the split vibration area when the driving frequency is above the frequency of the standing wave.

In a speaker utilizing such a resonance phenomenon, although the resonance phenomenon occurs on a sound wave generated by the piston vibration, no resonance phenomenon occurs on a sound wave generated by the split vibration because such a sound wave inherently contains much distortion.

When no resonance phenomenon occurs, the low frequency sound range is not stressed or featured. Instead, the middle/high frequency sound range is stressed or featured and the speaker cannot function as a woofer.

In contrast, the speaker of FIG. 3 including the piezoelectric sounding body functions as a woofer by utilizing a resonance phenomenon defined by the volume of the main body and the shape of the first opening and a resonance phenomenon defined by the volume of the lid members and the shape of the second openings.

When sound waves caused by the split vibration generated from the two sounding bodies exist within the main body of the speaker of FIG. 3, the sound waves in the middle/high frequency sound range are canceled within the main body and no sound waves in the middle/high frequency sound range caused by the split vibration are emitted from the first opening because the phases of the sound waves in the middle/high frequency sound range generated respectively from the two sounding bodies have phases which are opposite to each other.

However, the sound waves generated inside the lid members is different from that generated inside of the main body. Only the sound waves caused by the split vibration generated from one of the two sounding bodies exists within the lid members and the sound waves in the middle/high frequency sound range caused by the split vibration are not canceled.

Accordingly, the sound waves in the middle/high frequency sound range caused by the split vibration are emitted from the second opening of the lid members and are not canceled. This high frequency sound range cannot be absorbed fully by the sound absorber, so that sound waves both in the high frequency sound range and the low frequency sound range are emitted from the second openings. Further, because the sound waves caused by the split vibration do not create a resonance phenomenon, the sound of the speaker for the woofer is emitted with much distortion and very low sound level or amplitude.

SUMMARY OF THE INVENTION

To overcome the problems described above, the preferred embodiments of the present invention provide a speaker which has very small size and achieves generation of only the low frequency sound range with a clear and significantly increased sound level.

According to preferred embodiments of the present invention, a speaker includes a main body having open sections at both ends thereof; first and second sounding bodies which are provided at open sections at both ends of the main body and each of which comprises a piezoelectric body which is vibrated by electrical signals; first and second lid members provided so as to cover the first and second sounding bodies; and a first opening provided at the side portion of the main body and a second opening provided at the bottom portion of the lid members, wherein the first and second sounding bodies are driven in the direction in which internal pressure of the main body and internal pressure of the lid members are increased/decreased. The speaker also includes a membrane which is located between the sounding body end each of the second openings within the lid members.

As a result of this structure, the sound waves caused by the split vibration occurring from one sounding body is emitted to the outside from the second openings provided on the lid members after being damped by the membrane. The membrane is arranged and adapted to transform the split vibration into sound waves having no distortion because the displacement of the sound waves caused by the split vibration is suppressed by contacting the membrane. Accordingly, the speaker of the preferred embodiments of the present invention suppresses distortion and unpleasant sound and generates a clear, significantly louder sound in only the lower frequency sound range so that the speaker is excellent for use as a woofer.

These and other elements, features, and advantages of the preferred embodiments of the present invention will be apparent from the following detailed description of the preferred embodiments of the present invention, illustrated in the accompanying drawings.

DETAILED DESCRIPTION OF PREFERRED EMBODIMENTS

Figure 1:
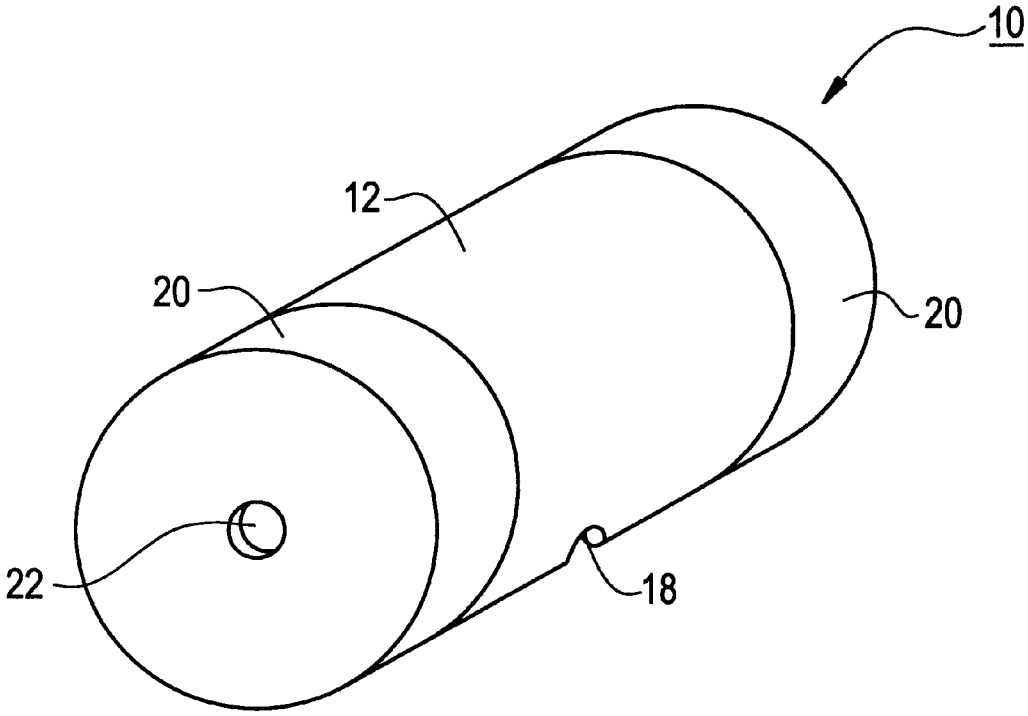
FIG. 1 is a perspective view showing a structure of a speaker according a preferred embodiment of the present invention.
Figure 2:
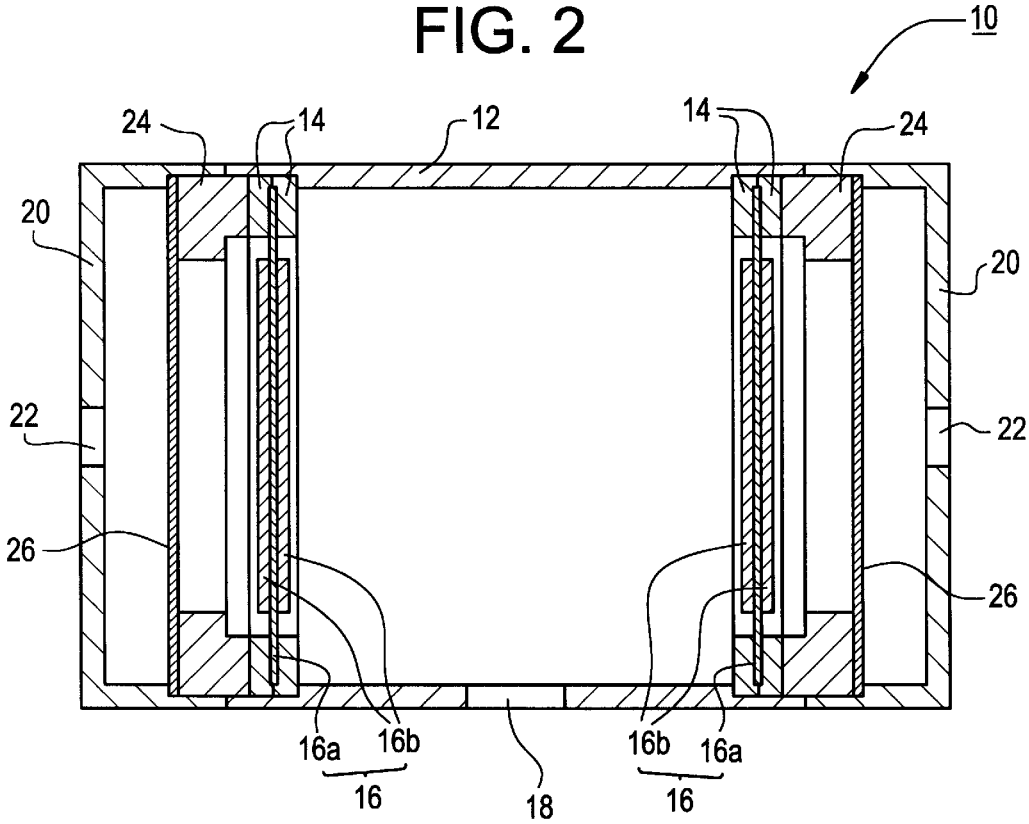
FIG. 2 is a section view showing the structure of the speaker according to FIG. 1.
Figure 3:
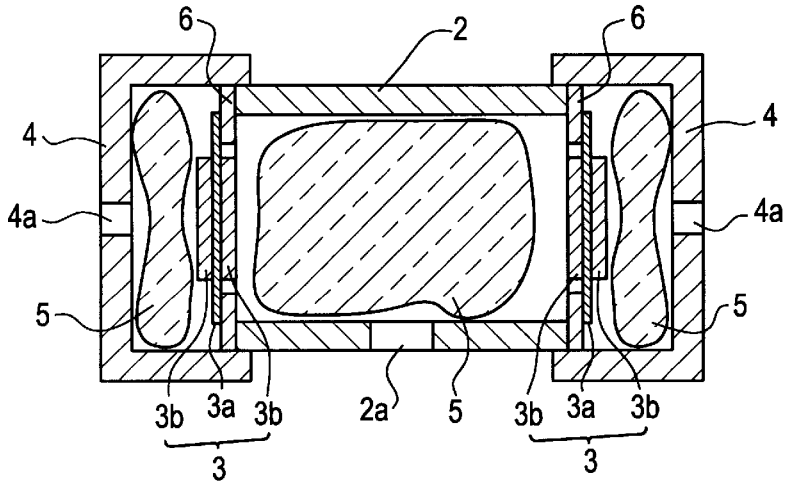
FIG. 3 is a section view showing a structure of a speaker which is the subject of a related co-pending application and which forms the basis of the present Continuation-In-Part Application.

FIGS. 1 and 2 show a speaker according to a preferred embodiment of the present invention. A speaker 10 includes a main body 12 having open sections at both ends thereof. Ringed first dampers 14 and 14 are provided at the open sections at both ends of the main body 12 and sounding bodies 16 are secured so that an entire area the inside of the main body 12 is kept air-tight (except for an opening 18) while being pinched by the first dampers 14 and 14. A first opening 18 is provided preferably at substantially the middle part of the side of the main body 12.

Further, a ringed second damper 24 is secured to each of the first dampers 14 along the direction approaching to the open section of the main body 12 from the sounding body 16. A disc-like membrane 26 is secured to each of the second dampers 24 and a lid member 20 is provided over each of the membranes 26. The lid members 20 are secured so as to cover the open section of the main body 12 and to keep an entire area inside of the lid members 20 air-tight (except for an opening 22). A second opening 22 is preferably provided around substantially the middle of the bottom of the lid member 20.

Each membrane 26 is preferably located between the second opening 22 of each lid member 20 and the sounding body 16.

The main body 12 and the lid members 20 are preferably made of a synthetic resin material such as plastic or a wood cut out into the cylindrical shape. However, other suitable materials and shapes may also be used for the main body 12 and lid members 20. The sounding body 16 also preferably comprises a disc-like vibrating plate **16*a* made of metal for example and disc-like piezoelectric elements 16*b* are secured preferably at substantially the middle part of both main surfaces of the vibrating plate 16*a* on a concentric circle of the vibrating plate 16*a* respectively to be arranged to define a vibration source having a bimorph structure. Although not shown specifically, the piezoelectric element 16*b*** is preferably fabricated by forming electrode films on both main surfaces of the disc-like piezoelectric body.

Preferably, the first damper 14 and the second damper 24 are made of a material having a large mass.

Further, the membrane 26 is preferably made of an elastic material such as a silicon rubber sheet or other suitable material.

Furthermore, although not shown specifically, the speaker 10 is preferably placed on a supporting member (not shown) so that the first opening 18 of the main body 10 is spaced from and faces downwardly relative to the supporting member.

One of the two sounding bodies 16 is connected to a first input terminal (not shown) provided on the outside of the main body 12 preferably via a lead wire (not shown) and a second of the two sounding bodies 16 is connected to another input terminal (not shown) provided on the outside of the main body 12 preferably via another lead wire (not shown).

When an electrical signal is input from an amplifier (not shown) to the first input terminal, one of the sounding bodies 16 vibrates and when an electrical signal from the amplifier (not shown) is input to the second input terminal, the other of the sounding bodies 16 vibrates.

Then, the sounding bodies 16 are driven so that the internal pressure of the main body 12 is increased/decreased at the same time by the sounding body 16 in the speaker 10 thus constructed. That is, when one channel signal, e.g. a right channel signal, of a stereo signal is input to one input terminal, the other channel signal, i.e. a left channel signal, of the stereo signal is input to the other input terminal.

By inputting signals as described above, sound waves are generated within the main body 12 from the two sounding bodies 16 and resonance occurs between the main body 12 and the first opening 18. Only the resonant frequency generated by this resonance is emitted to the outside of the main body 12 from the first opening 18.

Here, the low frequency sound range having no phase difference between the right channel signal and the left channel signal is emitted to the outside of the main body 12 as a double pressure resonant frequency which was synthesized from the right channel signal and the left channel signal. As a result, a significantly increased sound pressure is obtained despite the overall size of the main body 12 being very small, so that the speaker 10 emits sound waves in a full and complete low frequency sound level and has a significantly increased sound amplitude or output sound level.

The middle/high frequency sound range having a phase difference between the right channel signal end the left channel signal is canceled as the right channel signal and the left channel signal are combined, so that the low sound frequency range of the sound to be emitted is stressed or featured further.

Sound waves are also generated within sealed inner portions located between each of the lid members 20 and the main body from the two sounding bodies 16 and resonance occurs between the lid members 20 and the second openings 22. Consequently, only a resonant frequency generated by this resonance is emitted to the outside of the lid members 20 from the second openings 22.

Because the sounding body 16 is composed of the plate-like piezoelectric body in the speaker 10 of preferred embodiments of the present invention, a vibration area of the sounding body 16 is divided into a piston vibration area and a split vibration area according to a frequency of a signal input to the sounding body 16.

Although a resonance phenomenon occurs in sound waves generated from the piston vibration area of the sounding body 16, no resonance phenomenon occurs in sound waves generated from the split vibration area because such sound waves inherently have a large amount of distortion.

When the sound waves caused by the split vibration generated from the two sounding bodies 16 exist within the main body 12, the sound waves in the middle/high frequency sound range are canceled within the main body 12 and no sound waves in the middle/high frequency sound range caused by the split vibration are emitted from the first opening 18 because the phases of the sound waves in the middle/high frequency sound range generated respectively from the two sounding bodies 16 have phases which are opposite from each other.

The sound waves generated inside the sealed portions between the main body and each of the lid members are different from the sound waves inside of the main body 12. Only the sound waves caused by the split vibration generated from one of the sounding bodies 16 exists within the lid member 20 and the sound waves in the middle/high frequency sound range caused by the split vibration are not canceled. However, the sound waves caused by the split vibration generated from the one sounding body 16 within the lid member 20 is emitted to outside of the speaker from the second opening 22 of the lid member 20 after the sound waves are damped by the membrane 26 provided between the lid member 20 and the second opening 22. This occurs because the membrane 26 acts as a wall for transforming the sound waves caused by split vibration into sound waves having no distortion because the distortion caused by the split vibration is suppressed or eliminated by contacting the membrane 26.

Consequently, the speaker 10 eliminates or suppresses a distortion and unpleasant sound while generating a clear sound having a significantly increased amplitude or sound level.

Further, the membranes 26 protect the sounding bodies 16 from dust and the like which might otherwise infiltrate through the second opening 22. The member 26 also protects the sounding bodies 16 environmental changes around the speaker 10 such as changes in temperature.

It is noted that although not shown specifically, sound absorbers made of glass wool may be provided within the main body 12 and the lid member 20. Because such sound absorber are arranged to absorb and damp the middle/high frequency sound range of the sound waves generated within the main body 12 and the lid members 20, the low frequency sound range of the output sound waves are further emphasized and stressed.

When an electrical signal is input to the two sounding bodies 16 so that the internal pressure of the main body 12 is increased/decreased by the two sounding bodies 16, sound waves are generated within the main body 12 from the two sounding bodies 16 and are emitted to the outside from the first opening 18 of the main body 12. Because a diameter of the first opening 18 is set to be smaller than the sounding body 18, the amplitude of the sound waves emitted from the first opening 18 becomes larger than the amplitude of the sound waves generated from the sounding body 16. Therefore, the speaker 10 of the preferred embodiments of the present invention achieves significant miniaturization because of providing a plate-like piezoelectric body as the sounding body which is smaller and thinner than a sounding body consisting of a cone plate used in the prior art speaker, but also the speaker 10 generates a full range of low frequency sound with significantly increased amplitude.

Further, the speaker 10 of the preferred embodiments of the present invention achieves output of a compete low frequency sound range via a simple structure and at low cost and is adapted to be used as a center channel woofer for a 3D sound system. These advantages are achieved because an acoustic low-pass filter is defined by attaching the two sounding bodies on one main body, by generating sound that results from a combined output of the right channel signal and the left channel signal and by utilizing only sound pressure from the openings provided on the main body and the lid member.

It is noted that although the main body in the preferred embodiments shown in FIGS. 1 and 2 has a substantially cylindrical shape, the main body may be formed into any shape. In addition, the lid member may be formed to have any suitable shape.

Further, the vibrating plate and the piezoelectric elements composing the sounding bodies may be formed into any shape such as a square plate, for example. The vibrating plate maybe formed of rubber, synthetic resin, metal or other suitable material.

The sounding bodies including the piezoelectric elements preferably have a bimorph structure. However, sounding bodies including a piezoelectric element having a unimorph structure or a sounding bodies using a piezoelectric element having a laminated structure made of ceramic and using three or more layers of laminated piezoelectric layers may be used.

Further, although the membrane and the second damper are shown as being separately formed, it is not necessary or required that the membrane and second damper be separately formed. Instead, the membrane and the second damper may be molded in a single, unitary body.

As described above, according to the speaker of preferred embodiments of the present invention, the sound waves caused by the split vibration generated from one sounding body are emitted to the outside from the second opening provided on the lid member after being damped by the membrane which transforms such sound waves into sound waves having no distortion because the displacement of the sound waves caused by the split vibration is eliminated or suppressed by contacting the membrane.

Accordingly, the speaker of the preferred embodiments of the present invention suppresses distortion and unpleasant sound and generate a clear, significantly louder sound in only the lower frequency sound range so that the speaker is excellent for use as a woofer.

While the invention has been particularly shown and described with reference to the preferred embodiments thereof, it will be understood by those skilled in the art that the foregoing and other changes in form and details may be made thereto without departing from the spirit and scope of the invention.

What is claimed is:

1. A speaker, comprising:

a main body having open sections at both ends thereof;

first and second sounding bodies each provided at a respective one of the open sections at both ends of said main body and which are vibrated by electrical signals;

first and second lid members arranged to cover a respective one of said two sounding bodies;

a first opening provided at a side portion of said main body and second openings provided at a bottom portion of each of said first and second lid members; and a membrane located between each of said first and second sounding bodies and respective ones of said second openings in said first and second lid members.

2. The speaker according to claim 1, wherein said first and second sounding bodies are arranged to be driven in a direction in which internal pressure of said main body and internal pressure of said first and second lid members is increased/decreased.

3. The speaker according to claim 1, wherein a resonance frequency within said main body is differentiated from a resonance frequency within inner portions defined between said main body and each of said first and second lid members.

4. The speaker according to claim 1, wherein each of said membranes comprises a disc-shaped member.

5. The speaker according to claim 1, wherein each of said membranes comprises an elastic material.

6. The speaker according to claim 1, wherein each of said membranes comprises a silicon rubber sheet.

7. The speaker according to claim 1, wherein the first and second sounding bodies comprise a piezoelectric body made of ceramic.

8. The speaker according to claim 1, wherein an acoustic low pass filter is defined by the arrangement of the first and second sounding bodies and the first and second lid members on said main body.

9. The speaker according to claim 1, wherein the first and second sounding bodies each comprise a piezoelectric body arranged to have a bimorph structure.

10. A speaker, comprising:

a main body having open sections at both ends thereof;

first and second sounding bodies each provided at a respective one of the open sections at both ends of said main body and which are vibrated by electrical signals;

first and second lid members arranged to cover a respective one of said two sounding bodies;

a first opening provided at a side portion of said main body and second openings provided at a bottom portion of each of said first and second lid members; and a damping member arranged to suppress sound waves caused by split vibration generated by one of said first and second sounding bodies and to prevent said sound waves caused by split vibration from being emitted from the second openings.

11. The speaker according to claim 10, wherein said damping member comprises a membrane located between each of said first and second sounding bodies and respective ones of said second openings in said first and second lid members.

12. The speaker according to claim 10, wherein said first and second sounding bodies are arranged to be driven in a direction in which internal pressure of said main body and internal pressure of said first and second lid members is increased/decreased.

13. The speaker according to claim 10, wherein a resonance frequency within said main body is differentiated from a resonance frequency within inner portions defined between said main body and each of said first and second lid members.

14. The speaker according to claim 10, wherein said damping member comprises a disc-shaped member.

15. The speaker according to claim 10, wherein said damping member comprises an elastic material.

16. The speaker according to claim 10, wherein each of said membranes comprises a silicon rubber sheet.

17. The speaker according to claim 10, wherein the first and second sounding bodies comprise a piezoelectric body made of ceramic.

18. The speaker according to claim 10, wherein an acoustic low-pass filter is defined by the arrangement of the first and second sounding bodies and the first and second lid members on said main body.

* * * * *